US007290572B2

(12) United States Patent
Silva

(10) Patent No.: US 7,290,572 B2
(45) Date of Patent: Nov. 6, 2007

(54) METHOD FOR PURGING A HIGH PURITY MANIFOLD

(76) Inventor: David James Silva, 11081 Negley Ave., San Diego, CA (US) 92131

( * ) Notice: Subject to any disclaimer, the term of this patent is extended or adjusted under 35 U.S.C. 154(b) by 89 days.

(21) Appl. No.: 11/160,801

(22) Filed: Jul. 10, 2005

(65) Prior Publication Data

US 2007/0006941 A1 Jan. 11, 2007

(51) Int. Cl.
*B65B 1/04* (2006.01)

(52) U.S. Cl. ..... 141/66; 141/65

(58) Field of Classification Search ..... 141/65, 141/66, 2, 18, 9, 100, 104, 67, 85, 82; 222/148, 222/152; 137/15.04, 209, 240; 134/1.2, 134/1.3, 37, 102.2, 166 C, 166 R
See application file for complete search history.

(56) References Cited

U.S. PATENT DOCUMENTS 5,657,786 A * 8/1997 DuRoss et al. ..... 137/15.01
5,711,354 A * 1/1998 Siegele et al. ..... 141/198
6,431,229 B1 8/2002 Birtcher et al.
6,457,494 B1 * 10/2002 Gregg et al. ..... 141/4
6,810,897 B2 * 11/2004 Girard et al. ..... 137/2
6,953,047 B2 * 10/2005 Birtcher et al. ..... 137/240
2003/0131885 A1 7/2003 Birtcher et al.

* cited by examiner

*Primary Examiner*—Steven O. Douglas

(57) ABSTRACT

A method for purging a manifold for the delivery of a high purity chemical by injecting of a purge gas into the manifold under vacuum conditions. In one embodiment, the method comprises a first step of injecting a purge gas into the manifold at a first end while applying vacuum at a second end; a second step of closing the first end and evacuating the manifold by applying vacuum at the second end; and a third step of opening the first end and injecting purge gas into the manifold at the first end while applying vacuum at the second end, causing a turbulent flow of the purge gas along the internal walls of the manifold due to the pressure differential between the purge gas and the evacuated manifold. An effective removal of residuals of the high purity chemical within the manifold is thereby achieved.

19 Claims, 4 Drawing Sheets

METHOD FOR PURGING A HIGH PURITY MANIFOLD

STATEMENT REGARDING FEDERALLY SPONSORED RESEARCH AND DEVELOPMENT

Not applicable.

REFERENCE TO A COMPUTER LISTING, A TABLE, OR A COMPUTER PROGRAM LISTING COMPACT DISK APPENDIX

Not applicable.

BACKGROUND OF THE INVENTION

1. Field of the Invention

The present invention concerns a method for purging a high purity manifold, and, more particularly, a method for purging that comprises the injection of a purge gas into the manifold while vacuum is applied to the manifold.

2. Description of Related Art

High purity chemical delivery systems typically comprise manifolds that include diaphragm valves connected by conduits and connectors that connect the manifold to adjoining equipment.

For instance, in the semiconductor industry, high purity chemicals such as tetrakis (dymethilamino) titanium (TDMAT), tetrakis (diethylamino) titanium (TDEAT), tantalum pentaethoxide (TAETO), copper hexafluoroacetylacetonate-trimethylvinylsilane (Cu(hfac)TMVS), tetramethyltetracyclosiloxane (TMCTS), tetraethyl ortosilicate (TEOS), and trimethylphosphate (TMP) are delivered from a primary storage container to a process tool or to a secondary storage container by means of manifolds that regulate the flow of the high purity chemical during ordinary process conditions, and that also regulate the flow of pressurized gases and of vacuum during purge cycles.

When a storage container has exhausted the supply of high purity chemical and must be replaced, the manifolds connected to the container must be thoroughly purged prior to and after the installation of the new container, in order to remove any impurities and any ambient gases that may have entered the system during the container replacement process. Purge cycles must also be performed when a storage container is refilled rather than replaced, and when a component attached to the manifold (for instance, a flow controller) is replaced. Due to the high purity levels required, these purge cycles are extremely time consuming and generate an increase in manufacturing costs due to the related manufacturing down-times, to the large amounts of purge gas required, and to the increased wear on the filter systems installed in the plant.

Such high purity manifolds are designed to transport the chemical with a laminar flow. Consequently, the removal during the purge cycle of any chemical residuals that may be still attached to the inner walls of the manifold is a highly inefficient process, as the velocity of the purge gas in the proximity of the manifold walls approaches zero under laminar flow conditions, thus creating points of stagnation. Therefore, the purge cycles in the prior art perform no effective removal of such chemical residuals.

Therefore, there is a need for a method for purging a manifold for the delivery of a high purity chemical that minimizes purge times and material consumptions.

There is a further need for a method for purging a manifold for the delivery of a high purity chemical that achieves a turbulent flow of the purge gas within the manifold without creating points of stagnation, thereby increasing the rate of removal of the high purity chemical that is attached to the inner walls of the manifold.

BRIEF SUMMARY OF THE INVENTION

A method is provided for purging a manifold for the delivery of a high purity chemical that comprises the injection of a purge gas into the manifold under vacuum conditions.

In one embodiment, the method comprises a first step of injecting a purge gas into the manifold at a first end while applying vacuum at a second end; a second step of closing the first end and evacuating the manifold by applying vacuum at the second end; and a third step of opening the first end and injecting a purge gas into the manifold at the first end while applying vacuum at the second end, causing a turbulent flow of the purge gas along the internal walls of the manifold due to the pressure differential between the purge gas and the evacuated manifold. An effective removal of residuals of the high purity chemical in the manifold is thereby achieved. In a variant of this embodiment, the first step is omitted.

In another embodiment, wherein a first end of the manifold is connected to a conduit external to the manifold that has a closed end, the method comprises a first step of evacuating the manifold by applying vacuum at the second end; and a second step of injecting a purge gas into the evacuated manifold at the second end, causing a turbulent flow of the purge gas along the internal walls of the manifold and further causing residuals of the high purity chemical in the manifold to be displaced into the conduit.

It is an advantage of the present invention to improve the efficiency of the purging process of a high purity manifold by creating a turbulent flow of the purge gas within the manifold.

It is another advantage of the present invention to reduce the cost of purging a high purity manifold by reducing the amount of purge gas employed and extending the life of a connected filter system.

BRIEF DESCRIPTION OF THE SEVERAL VIEWS OF THE DRAWINGS

The drawings constitute a part of this specification and include exemplary embodiments of the invention, which may be embodied in various forms. It is to be understood that in some instances various aspects of the invention may be shown exaggerated or enlarged to facilitate an understanding of the invention.

DETAILED DESCRIPTION OF THE INVENTION

Detailed descriptions of embodiments of the invention are provided herein. It is to be understood, however, that the present invention may be embodied in various forms. Therefore, the specific details disclosed herein are not to be interpreted as limiting, but rather as a representative basis for teaching one skilled in the art how to employ the present invention in virtually any detailed system, structure, or manner.

Figure 1:
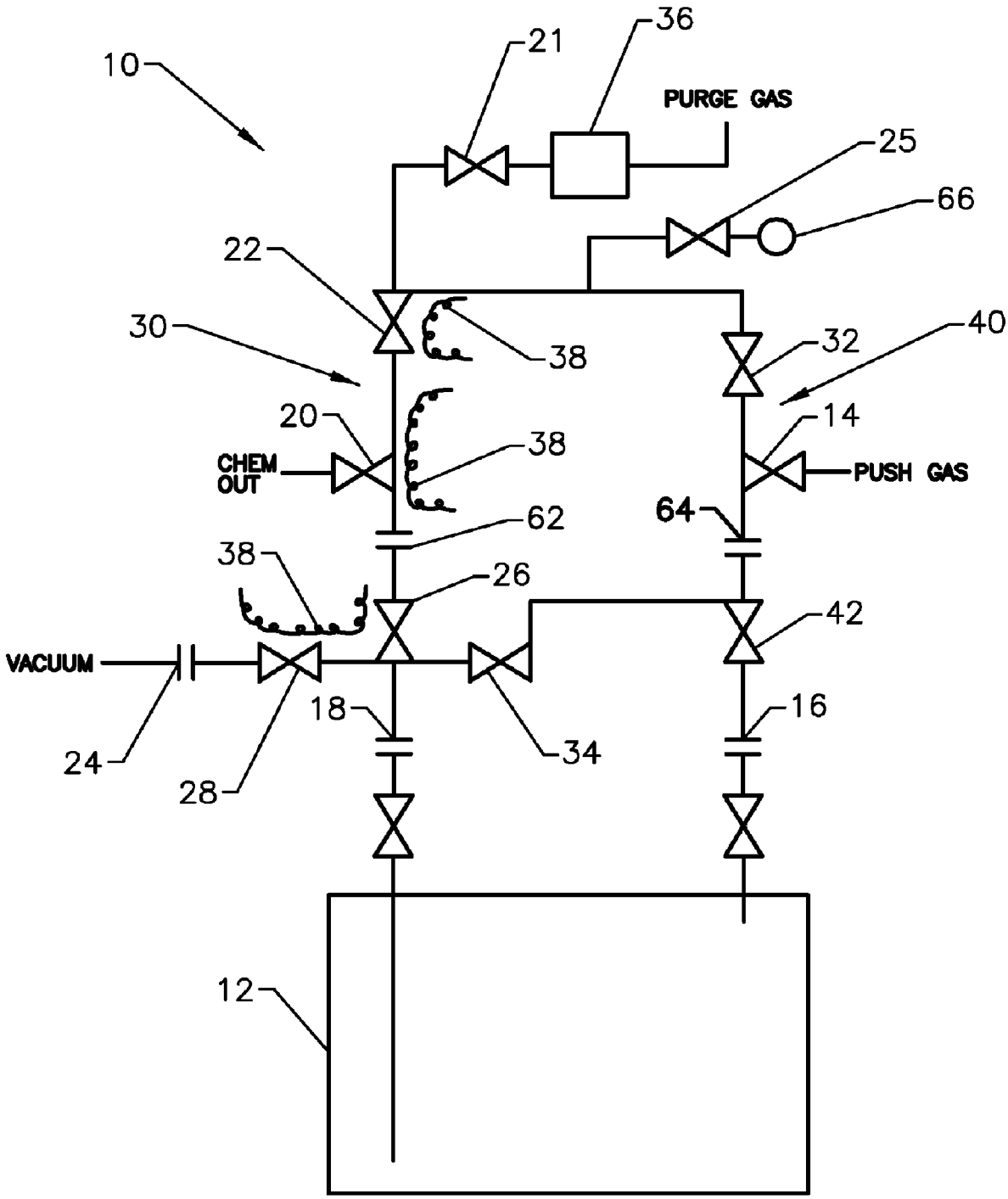
FIG. 1 is a schematic view of a first high purity manifold, as employed in a semiconductor manufacturing plant, for which a first embodiment of the invention may be practiced.

Turning first to FIG. 1, there is shown a typical structure of a manifold 10 for the delivery of a high purity chemical, as employed in a semiconductor manufacturing plant. During ordinary operation, a high purity chemical is stored in a container 12 in a liquid form, to be delivered to a point of utilization, such as a second container or a process tool. A push gas is injected into manifold 10 through a first diaphragm valve 14 and enters container 12 through a first connector 16 (typically, a VCR connector), connected to container 12. The ensuing pressurization within container 12 causes the high purity chemical to exit container 12 though a second connector 18 (typically, a VCR connector), also connected to the container, and to exit manifold 10 through a second diaphragm valve 20, to be eventually delivered to the point of utilization.

When container 12 is replaced, container 12 and its accessory equipment are typically detached by disconnecting manifold 10 at a third connector 24, fifth connector 62 and sixth connector 64 (typically, low dead space connectors). It becomes then necessary to purge portion 30 of manifold 10, which is delimited by a third diaphragm valve 22, second diaphragm valve 20, and a fourth diaphragm valve 26, and portion 40 of manifold 10, which is delimited by a sixth diaphragm valve 32, first diaphragm 14, and an eighth diaphragm valve 42. More particularly, if the seat sides of third diaphragm valve 22 and fourth diaphragm valve 26 face each other, and if the seat side of second diaphragm valve 20 faces the conduit connecting valves 22 and 26, portion 30 is comprised among the seat sides of valves 20, 22, and 26. Likewise, if the seat sides of valves 32 and 42 face each other, and if the seat side of valve 14 faces the conduit connecting valves 32 and 42, portion 40 is comprised among the seat sides of valves 32, 14, and 42.

In a first embodiment of the invention, which is described with reference to portion 30, portion 30 is purged by the contemporaneous application of a purge gas and vacuum. To perform the first embodiment, third diaphragm valve 22, second diaphragm valve 20, fourth diaphragm valve 26, and a fifth diaphragm valve 28 are initially set in an open position, while a sixth diaphragm valve 32 and a seventh diaphragm valve 34, as well as the container valve interposed between container 12 and second connector 18, are initially set in a closed position.

In a first step of the first embodiment, a purge gas (such as nitrogen) is injected into portion 30 at third diaphragm valve 22 while vacuum is applied at third connector 24, which causes a first amount of residuals of the high purity chemical to be pushed out of portion 30 into the vacuum source at third connector 24. The flow of the purge gas to portion 30 is regulated by a valve 21.

In a second step of the first embodiment, third diaphragm valve 22 is set to a closed position, while valves 26 and 28 are set to an open position. Portion 30 is evacuated by still applying vacuum at third connector 24, thereby removing gases and additional residuals of the high purity chemical that may be contained within portion 30.

In a third step of the first embodiment, third diaphragm valve 22 is set to an open position and a purge gas (either of the same chemistry as in the first step, or of a different chemistry) is injected in portion 30 at third diaphragm valve 22, while vacuum is applied at third connector 24. Because portion 30 had been evacuated during the second step, the pressure gradient between the positive pressure at third diaphragm valve 22, and the negative pressure at third connector 24, causes the purge gas to travel very rapidly within portion 30. More particularly, such a pressure gradient causes the purge gas to expand assuming a turbulent flow state within portion 30, which removes residuals of the high purity chemicals on the inner surfaces of portion 30 that would have been very difficult to remove in a laminar flow state.

One skilled in the art will appreciate that turbulence levels may be varied in portion 30 at different times and in different cycles, thereby varying purge effect.

In one application of the first embodiment, vacuum is applied during the second step for a predetermined amount of time, and the third step is then applied. The second step and third step are then repeated, until the vacuum within portion 30 drops to a predetermined level, as could be determined, among others, by monitoring the rate of rise of a vacuum transducer 66 positioned in an appropriate location of manifold 10, such as along the conduit connecting third diaphragm valve 22 and sixth diaphragm valve 32, or by monitoring the speed of evacuation during the second step of the first embodiment. The gas flow to transducer 66 may be regulated by opening and closing a valve 25, and the rate of rise of transducer 66 (or the lack thereof) provides an indication of whether the vacuum level in portion 30 has been reduced to the desired level. As an example, in one purge cycle, the flow of the purge gas during the first step lasts for approximately ten minutes, vacuum is then applied during the second step for approximately five minutes, and the purge gas is injected during the third step for one minute. The combination of the second and third step might be repeated thirty times. However, each of the above time amounts may vary in different purge cycles.

In another application of the first embodiment, vacuum is instead applied during the second step until transducer 66, positioned in an appropriate location of manifold 10, stabilizes. The injection of the purge gas in the third step is then performed, and the second and third steps are repeated until there is an indication that the interfaces in portion 30 have been cleaned to an acceptable level. Even in this case, each of the first, second, and third steps may be performed for different lengths of time.

One skilled in the art will further appreciate that the first embodiment may be practiced without the first step, that is, by performing only the above described second and third steps of the first embodiment. Still further, one skilled in the art will further appreciate that the purge effect of the first embodiment is enhanced by a design of portion 30 that comprises diaphragm valves with high flow coefficients ($C_v$).

The purging action of the first embodiment can also be enhanced by the addition of devices that control the temperature of the purge gas and of the residuals of the high purity chemical attached to the walls of portion 30. In one variant of the first embodiment, a thermal exchanger 36 is added to manifold 10, in order to control (either by increasing, decreasing, or maintaining constant) the temperature of the purge gas entering diaphragm valve 21. One example of thermal exchanger 36 is a heat exchanger, through which the purge gas would flow. Alternatively, a thermal conditioner (such as a heating or cooling device, for instance, a thermal wrap) may be applied to the conduit carrying the purge gas to the third diaphragm valve 22, in order to exchange heat with at least a portion of the purge gas conduit, and, consequently, with the purge gas itself.

In another variant of the first embodiment, one or more thermal conditioners 38, such as heating devices (for instance, a thermal wrap), are applied to at least a part of portion 30, in order to control (either by increasing, decreasing, or maintaining constant) the temperature of residuals of the high purity chemical adhering to the walls of the manifold, and to facilitate the purging action of the first embodiment.

In still another variant of the first embodiment, the temperature both of the purge gas and of the high purity chemical residuals are controlled by a combination of a thermal exchanger and/or thermal conditioner for the purge gas, and of one or more thermal conditioners for the high purity chemical residuals.

By practicing the purging method according to the first embodiment of the invention, a manifold used in a semiconductor manufacturing plant to transport TDMAT can be cleaned using approximately 16,000 cubic liters of purge gas, compared with approximately 105,000 cubic liters in the prior art. At the same time, because the purge cycle time is reduced compared to the prior art, the life of an applied filter system is extended, further increasing the cost savings achieved by the practice of the first embodiment.

While the first embodiment has been described in relation to portion 30 of manifold 10, its practice is equally applicable to portion 40 of manifold 10.

Further, while the first embodiment has been described in relation to a high purity chemical delivery system by liquid injection, its practice is equally applicable to a high purity chemical delivery system by employing a chemical vapor.

Figure 2:
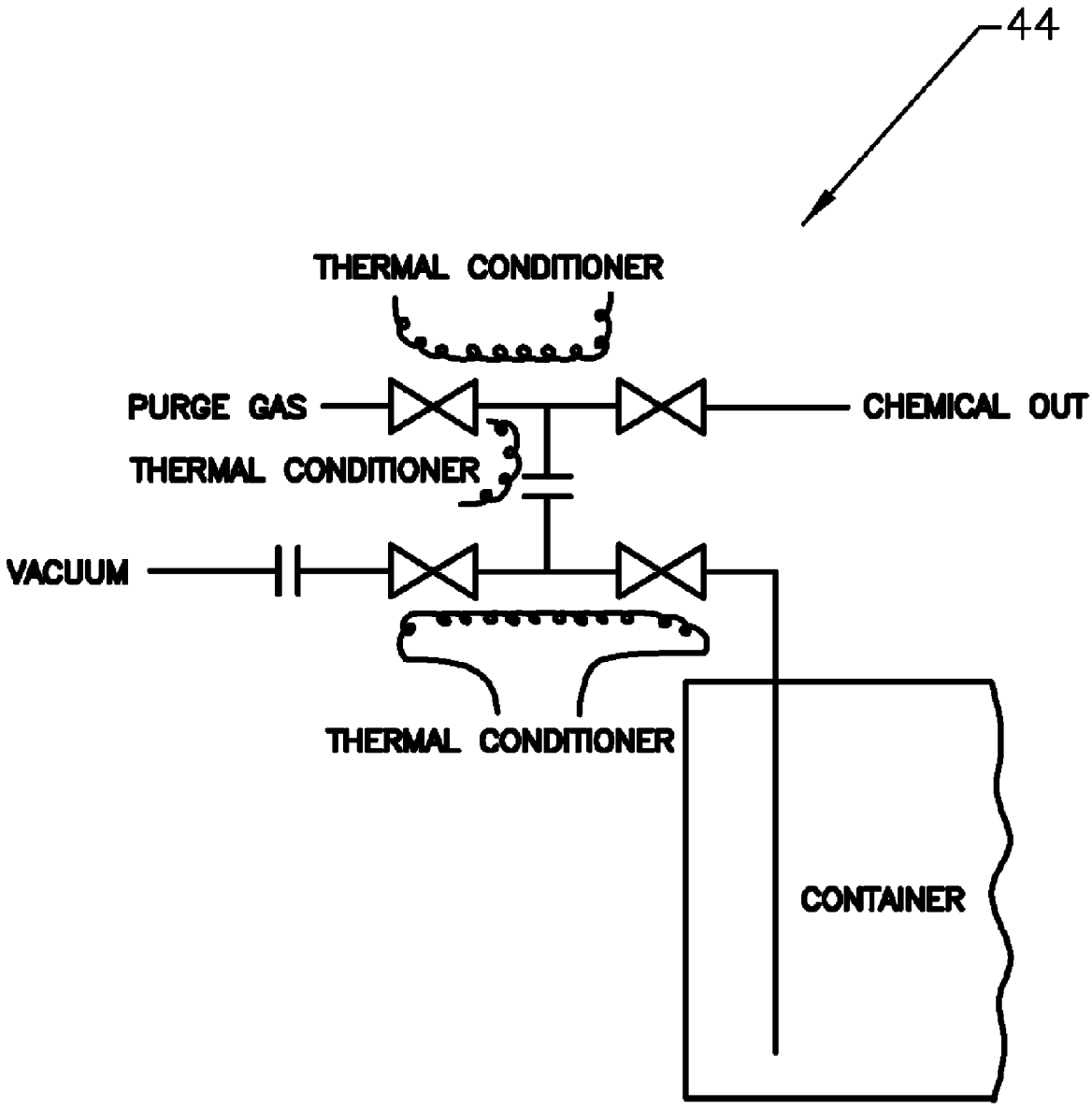
FIG. 2 is a schematic view of a second high purity manifold, as employed in a semiconductor manufacturing plant, for which the first embodiment of the invention may be practiced.
Figure 3:
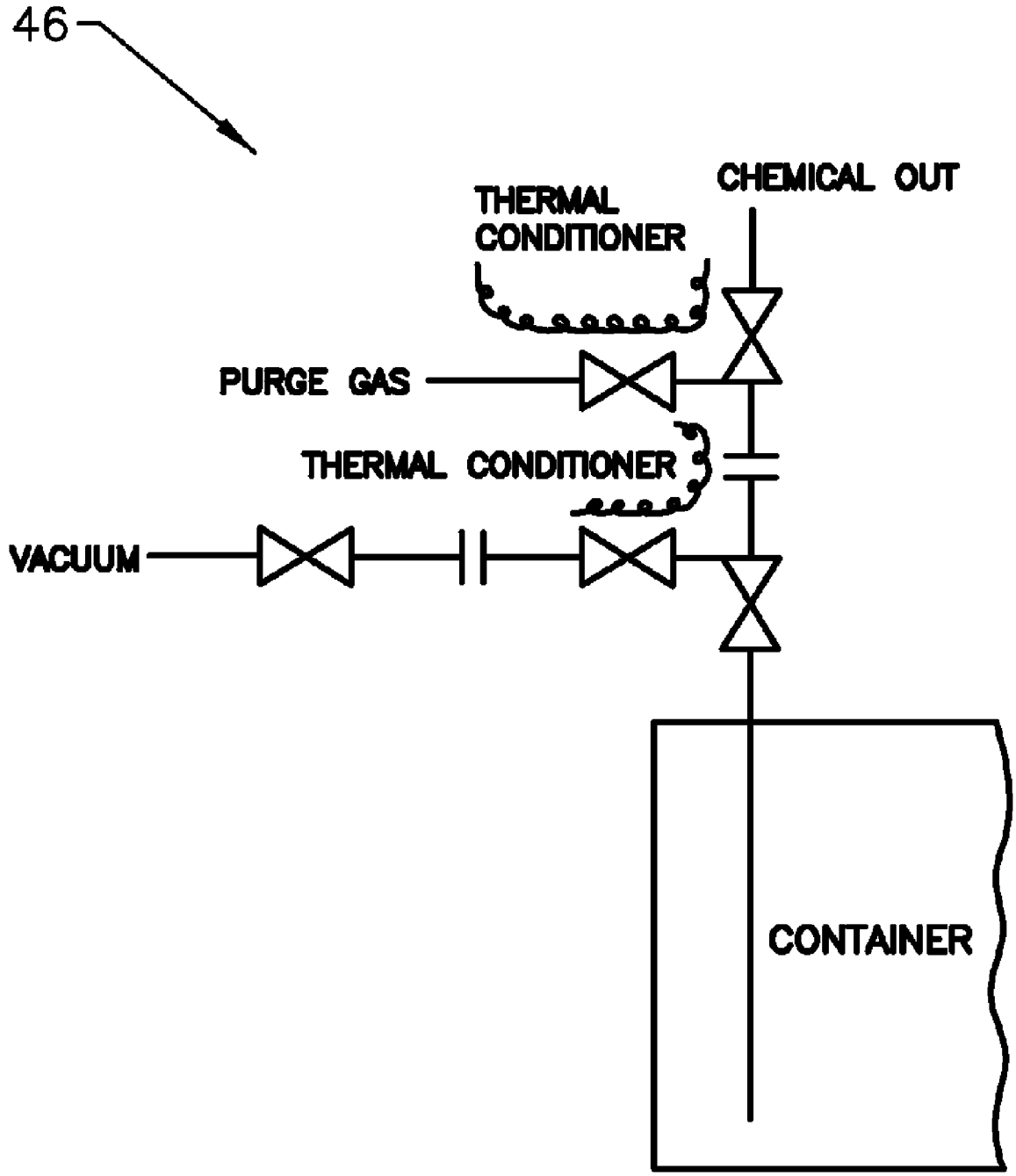
FIG. 3 is a schematic view of a third high purity manifold, as employed in a semiconductor manufacturing plant, for which the first embodiment of the invention may be practiced.

Still further, the first embodiment is also suitable for use with different manifold designs. A few non-limiting examples of alternative manifold designs, to which the practice of the first embodiment is also applicable, are manifold 44, illustrated in FIG. 2, and manifold 46, illustrated in FIG. 3.

Figure 4:
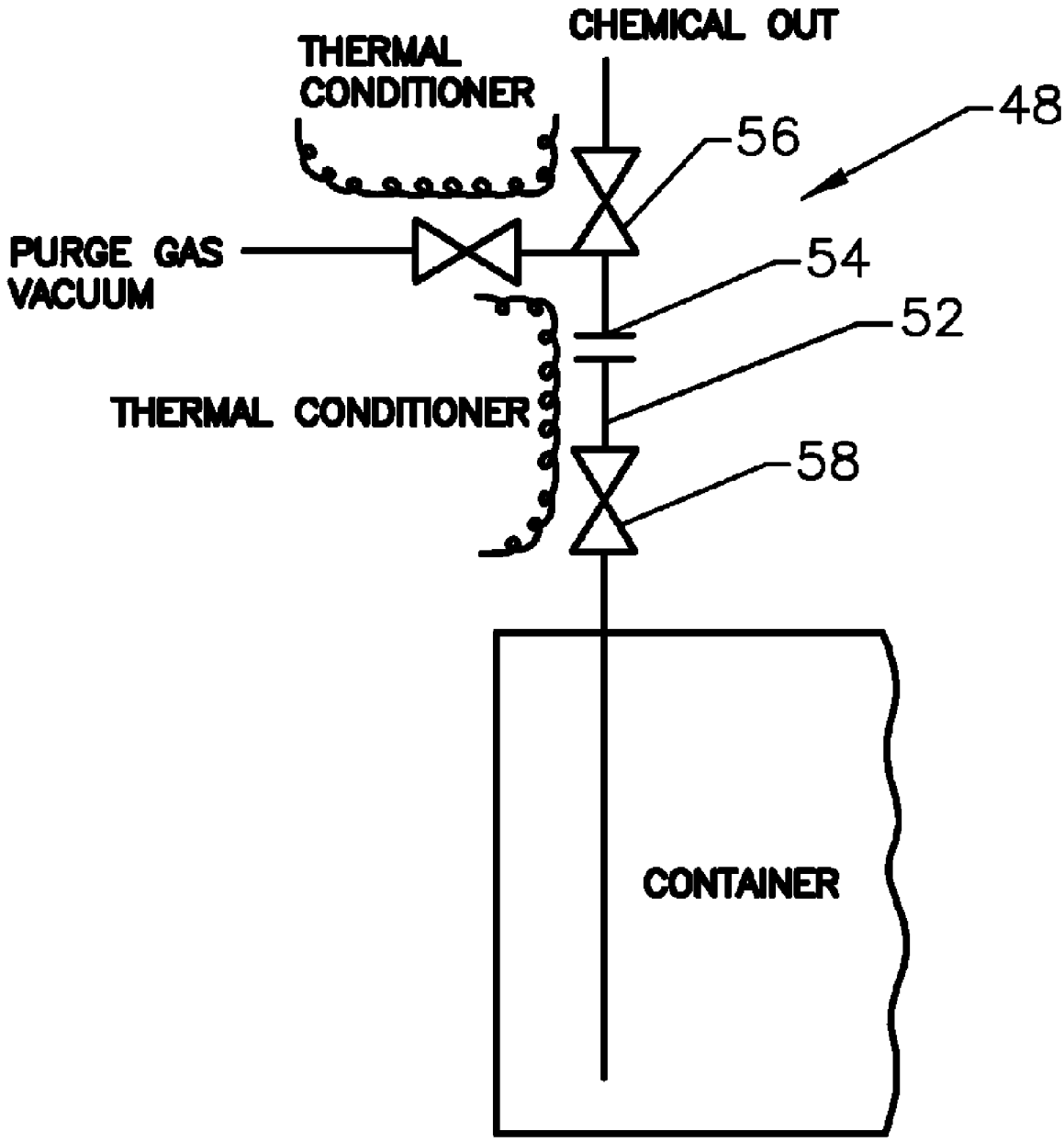
FIG. 4 is a schematic view of a fourth high purity manifold, as employed in a semiconductor manufacturing plant, for which a second embodiment of the invention may be practiced.

Turning now to FIG. 4, there is shown a manifold 48, for which the practice of a second embodiment of the invention is particularly suitable.

During ordinary operation, a liquid high purity chemical stored in container 50 is delivered to a point of utilization, such as a process tool or an intermediate storage container, by injecting a push gas into container 50 (through a first port, not shown in FIG. 4). This causes the high purity chemical to flow from container 50 through a second port and a valve 58, which regulates the flow of the high purity chemical between container 50 and manifold 48. The high purity chemical successively enters manifold 48 through a fourth connector 54 (typically, a VCR connector) situated at a first end of manifold 48, and finally exits manifold 48 after flowing through ninth diaphragm valve 56. A conduit 52 connects valve 58 to manifold 48, and is external to (not part of) manifold 48.

To perform the second embodiment, valve 58 and ninth diaphragm valve 56 are set in a closed position.

During a first step of the second embodiment, manifold 48 is evacuated by applying vacuum at a first end of manifold 48, connected to tenth diaphragm valve 60.

During a second step of the second embodiment, a purge gas, such as nitrogen, in injected into manifold 48 at the first end. Because manifold 48 had been previously evacuated, the purge gas expands through manifold 48 under near-vacuum conditions, traveling with a very high velocity and acquiring a turbulent flow. As in the first embodiment, such a turbulent flow causes the displacement of residuals of the high purity chemical attached to the inner walls of the manifold, and the ejection of such residuals into conduit 52 outside of manifold 48.

The variants described for the first embodiment apply also to the second embodiment. More specifically, the pressure gradient between the vacuum level obtained in manifold 48 during the first step and the positive pressure of the purge gas during the second step of this embodiment may be such to generate a shock wave within manifold 48, which increases the purging effect. Further, evacuation during the first step may be performed for a predetermined amount of time, followed by an injection of purge gas during the second step for a predetermined amount of time, and this cycle may be repeated until a predetermined vacuum level within manifold 48 has been reached, indicating the desired removal level of the chemical residuals. Alternatively, manifold 48 may be evacuated until the vacuum level within manifold 48 has reached a base level, after which the purge gas in injected, repeating the purge cycle until there is an indication that the interfaces within manifold 48 have been cleaned to an acceptable level.

Still further, the temperature of the purge gas may be controlled (increased, kept constant, or decreased) by having the purge gas flow through a thermal exchanger, or by having the walls of the conduit transporting the purge gas connected to a thermal conditioner, such as a heating system.

Still further, at least a portion of the walls of manifold 48 may be connected to one or more thermal conditioners (such as heating systems), as shown in FIG. 4, in order to control (increase, decrease, or keep constant) the temperature of the high purity chemical attached to the inner walls of manifold 48.

Still further, a combination of both a thermal exchanger and/or a thermal conditioner may be applied to the purge gas, and of one or more thermal conditioners may be connected to the walls of manifold 48.

While the invention has been described in connection with the above described embodiments, it is not intended to limit the scope of the invention to the particular forms set forth, but on the contrary, it is intended to cover such alternatives, modifications, and equivalents as may be included within the scope of the invention.

What is claimed is:

1. A method for purging a manifold for the delivery of a high purity chemical, the manifold having a first end and a second end, the method comprising the steps of:

(a) with the first end in a closed position and the second end in an open position, evacuating the manifold by applying vacuum at the second end; and (b) with the first end and the second end both in an open position, injecting purge gas into the manifold at the first end while applying vacuum at the second end, thereby causing a turbulent flow of the purge gas along the internal walls of the manifold and removing residuals of the high purity chemical in the manifold.

2. The method of claim 1, further comprising the step of:

with the first end and the second end both in an open position, injecting purge gas into the manifold at the first end while applying vacuum at the second end, prior to performing the step of evacuating the manifold by applying vacuum at the second end.

3. The method of claim 1, wherein the pressure differential between the first end and the second end is varied during the step of injecting purge gas into the manifold at the first end while applying vacuum at the second end.

4. The method of claim 1, wherein vacuum is applied during the step of evacuating the manifold by applying vacuum at the second end for a predetermined amount of time.

5. The method of claim 4, wherein both steps are performed one or more times until the amounts of high purity chemical remaining in the manifold is reduced to a predetermined level.

6. The method of claim 4, wherein vacuum is applied at the step of evacuating the manifold by applying vacuum at the second end for approximately five minutes and purge gas is injected in the step of injecting purge gas into the manifold at the first end while applying vacuum at the second end for approximately one minute, and wherein both steps are performed thirty times.

7. The method of claim 1, wherein vacuum is applied at the step of evacuating the manifold by applying vacuum at the second end for an amount of time sufficient to reduce the vacuum level in the manifold to a stabilized level.

8. The method of claim 1, wherein vacuum is applied at the step of evacuating the manifold by applying vacuum at the second end for a predetermined amount of time, and wherein vacuum is subsequently applied for an amount of time sufficient to reduce the vacuum level in the manifold to a stabilized level.

9. The method of claim 1, further comprising the step of controlling the temperature of the purge gas entering the manifold by providing a thermal exchanger that exchanges heat with the purge gas.

10. The method of claim 1, further comprising the step of controlling the temperature of the purge gas entering the manifold by providing a thermal conditioner that exchanges heat with the at least a portion of the conduit transporting the purge gas to the manifold.

11. The method of claim 1, further comprising the step of controlling the temperature of the residuals of the high purity chemical in the manifold by providing one or more thermal conditioners that exchange heat with at least a portion of the manifold.

12. The method of claim 11, further comprising the step of controlling the temperature of the purge gas entering the manifold by providing a thermal exchanger that exchanges heat with the purge gas.

13. The method of claim 11, further comprising the step of controlling the temperature of the purge gas entering the manifold by providing a thermal conditioner that exchanges heat with the at least a portion of the conduit transporting the purge gas to the manifold.

14. A method for purging a manifold for the delivery of a high purity chemical, the manifold having a first end and a second end, the first end being connected to a conduit external to the manifold, the conduit having a closed end, the method comprising the steps of:

(a) evacuating the manifold by applying vacuum at the second end; and (b) injecting a purge gas into the evacuated manifold at the second end, thereby causing a turbulent flow of the purge gas along the internal walls of the manifold and causing residuals of the high purity chemical in the manifold to be displaced into the conduit.

15. The method of claim 14, further comprising the step of altering the temperature of the purge gas entering the manifold by providing a thermal exchanger that exchanges heat with the purge gas.

16. The method of claim 14, further comprising the step of altering the temperature of the purge gas entering the manifold by providing a thermal conditioner that exchanges heat with the at least a portion of the conduit transporting the purge gas to the manifold.

17. The method of claim 14, further comprising the step of controlling the temperature of the residuals of the high purity chemical in the manifold by providing one or more thermal conditioners that exchange heat with at least a portion of the manifold.

18. The method of claim 17, further comprising the step of altering the temperature of the purge gas entering the manifold by providing a thermal exchanger that exchanges heat with the purge gas.

19. The method of claim 17, further comprising the step of altering the temperature of the purge gas entering the manifold by providing a thermal conditioner that exchanges heat with the at least a portion of the conduit transporting the purge gas to the manifold.

* * * * *